United States Patent [19]

Grant

[11] 4,063,639

[45] Dec. 20, 1977

[54] DISPLAY AND STORAGE DEVICE FOR SMALL ARTICLES

[76] Inventor: Robert F. Grant, 3234 S. Cuyler, Berwyn, Ill. 60402

[21] Appl. No.: 690,789

[22] Filed: May 27, 1976

[51] Int. Cl.[2] ..... B65D 85/58; A47F 3/00

[52] U.S. Cl. ..... 206/0.82; 206/.84; 206/446; 215/329; 220/4 B; 220/304

[58] Field of Search ..... 206/.82, .8, .83, .84, 206/446, 45.31; 220/304, 4 B; 215/329, 341

[56] References Cited

U.S. PATENT DOCUMENTS

| | | | |
|---|---|---|---|
| 2,258,535 | 10/1941 | Buranelli | 206/.83 |
| 2,434,553 | 1/1948 | Ensley | 206/.83 |
| 2,876,926 | 3/1959 | Gronemeyer | 220/304 |
| 2,906,429 | 9/1959 | Marchyn | 220/304 |
| 3,139,977 | 7/1964 | Burdick | 206/.83 |
| 3,145,833 | 8/1964 | Muller | 206/.83 |
| 3,635,335 | 1/1972 | Kramer | 206/.82 |
| 3,751,128 | 8/1973 | Skinner et al. | 206/.8 |
| 3,782,537 | 1/1974 | Segel | 206/.82 |
| 3,788,464 | 1/1974 | Skinner | 206/.82 |

FOREIGN PATENT DOCUMENTS

| | | | |
|---|---|---|---|
| 2,234,954 | 1/1974 | Germany | 206/.82 |
| 177,726 | 3/1958 | Sweden | 220/304 |

*Primary Examiner*—William Price
*Assistant Examiner*—Bruce H. Bernstein

[57] ABSTRACT

A display and storage device for articles such as coins, medals, tokens and the like includes first and second mating cup members of a transparent material, each of the cup members having threaded surfaces enabling the cup members to be screwed together encapsulating the article and forming a generally airtight enclosure for the article. A plurality of the storage devices may be mounted on an apertured display board either directly or by way of a two piece holder including a pair of threaded cup members.

11 Claims, 8 Drawing Figures

DISPLAY AND STORAGE DEVICE FOR SMALL ARTICLES

BACKGROUND OF THE INVENTION

1. Field of the Invention.

This invention relates to article display and storage devices, and more particularly to a two-piece storage device adapted to receive a small article, such as a coin, a medal, a token or the like, and provide a generally air-tight capsule for enclosing the article.

2. Description of the Prior Art

Various display devices have been proposed for storing articles, such as coins, tokens, medals, stamps, and the like which comprise a collection of such articles. For example, in coin collecting, one of the most widely used coin holders is the Whitman holder which comprises a heavy paper or cardboard booklet having a plurality of leaves each of which comprises a heavy pressed paper page, which is apertured to permit display of both sides of the coins. The coins are held in place by plastic sleeves which are inserted between the board and an attached paper lamination.

It is known that coins stored in such storage devices are subject to tarnish from prolonged contact with the paper which comprises the leaves of the album. In addition, the plastic sleeve does not provide an airtight seal for the coins, and accordingly, the coins are subject to tarnish from contaminents in the air.

Other known display and storage devices provide a transparent holder to encapsulate the coins to minimize tarnishing of the coins from contaminants in the air. A popular coin holder in use consists of a plastic coin board sandwiched by two transparent sheets which are fastened together by screws. This type of holder requires complete disassembly to add or remove a single coin, which is time consuming and exposes all of the other coins on the board to damage from handling.

Another article storage device, which is particularly adapted to mounting a coin on a mounting board, includes two flanged cup members which are received in a recess formed in the mounting board and which are held together by a friction type lock provided by interlocking peripheral beads formed on the outer wall of one cup member and the inner wall of the other cup member. A coin is added to the mounting board by placing the coin in one of the cup members and then inserting the mating cup members into an aperture of the board from opposite sides of the board and pressing the cup members together to lock the two cup members in place. However, to remove a coin from the board, the cup members must be pried apart to disengage the locking bead members before the two cup members can be separated, permitting the coin to be removed. Also, the coin may be subjected to damage from handling when it is added to or removed from the mounting board, and repeated use of the holder may result in wearing or breakage of the interlocking bead members, which would prevent the establishment of a suitable friction lock for the mating cup members.

A further known coin display apparatus employs a mounting board having a plurality of threaded recesses for receiving coins and a plurality of threaded cover members which are screwed into the recesses to enclose the coins and secure the coins to the board. To add a coin to the board, a threaded cover member is removed from the board, and the coin is placed in the corresponding recess. The threaded cover member is then screwed into the recess to enclose the coin. To remove a coin from the board, the threaded cover is unscrewed, exposing the coin which then can be lifted out of the recess in the board. However, this arrangement only provides for mounting of a plurality of coins and the coins are exposed to tarnishing or other damage in adding a coin to the mounting board or removing the coin from the mounting board.

Therefore, it would be desirable to have an article display and storage device for encapsulating an article, such as a coin, a medal, a token or the like, and which is simple to use and durable in construction. It would also be desirable to have a display and storage device which facilitates the addition or removal of an article to a display board without subjecting the article to damage from handling or exposure to the atmosphere.

SUMMARY OF THE INVENTION

The present invention has provided a display and storage device for an article which provides a substantially airtight container for the article and which permits an individual article to be mounted on or removed from a display board quickly and without subjecting the article, or other articles mounted on the same display board, to damage as may result from handling and also, exposure to the atmosphere.

In accordance with a disclosed embodiment, the display and storage device includes first and second cup members each being generally cylindrical in shape and having a base portion and an annular wall portion extending generally perpendicularly from respective base portions. The wall portion of the first cup member defines a central recess for receiving an article and has threads formed on an outer surface thereof. The inner diameter of the threaded wall portion of the second cup member is substantially the same as the outer diameter of the threaded wall portion of the first cup member to permit the first and second cup members to be assembled together with corresponding threaded wall portions in threaded engagement, providing a substantially airtight capsule for enclosing the article. The base portions of the cup members are of a transparent material to provide viewing surfaces for the article stored therein.

The threaded wall surfaces of the two cup members permit quick and easy assembly of the storage device with an article to be stored, and provide positive locking of the two cup members. In addition, the increased surface area provided by the mutually engaging threaded surface enhances sealing of the storage compartment and substantially eliminates air leakage into the compartment.

In accordance with the present invention, the storage device may be mounted on an apertured display or mounting board, either directly or by way of a mounting means. In one direct mounting arrangement, the storage device is received in an aperture of the board and is maintained in the aperture by way of a friction fit. Another embodiment employs a pair of flanged cup members which facilitate mounting of the storage device directly to the board.

A further embodiment employs a mounting means including a base member and a cover member having mating threaded surfaces, permitting the base member and the cover member to be screwed together, partially enclosing the storage device and securing the storage device to the mounting board.

In another mounting arrangement, one of the cup members which comprise the storage device has an externally threaded surface which is received in threaded engagement with an internally threaded surface of a mounting member to secure the storage device to the mounting board.

DESCRIPTION OF PREFERRED EMBODIMENTS

Figure 1:
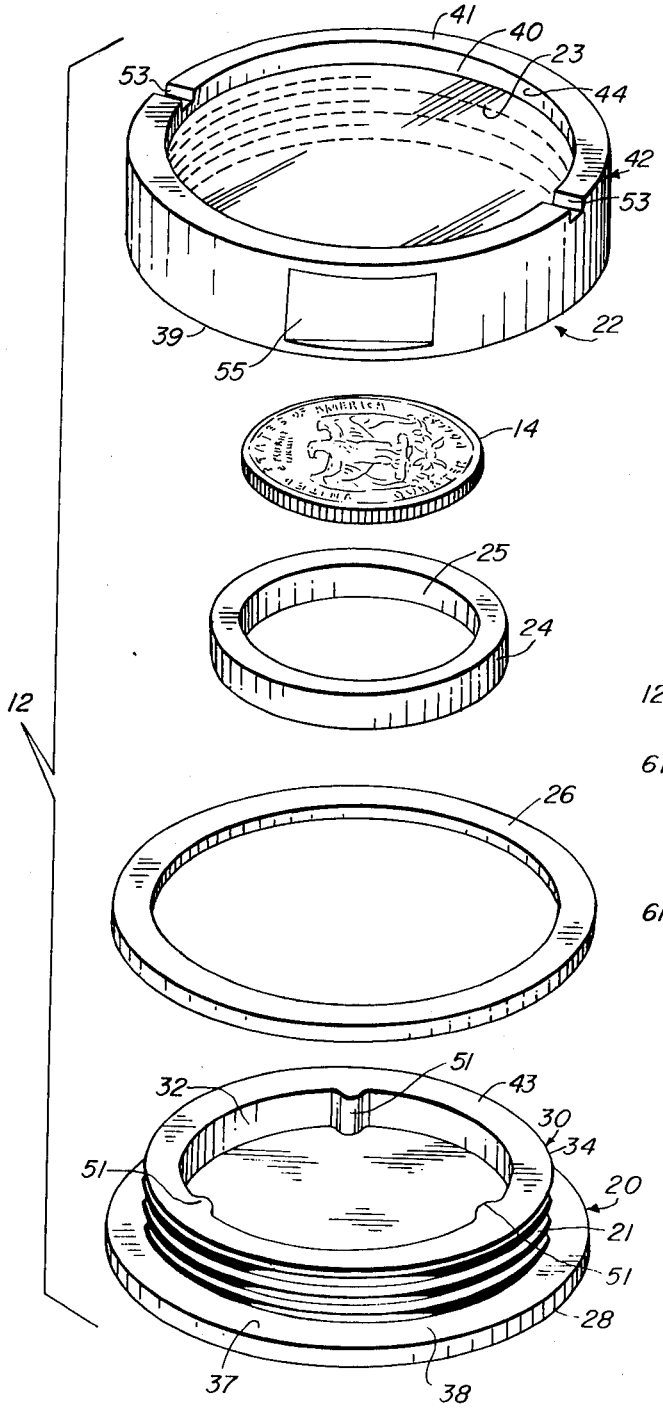
FIG. 1 is an exploded perspective view of one embodiment for an article storage device provided by the present invention.

Referring to the drawings, FIG. 1 is an exploded perspective view of one embodiment for an article storage device 12 provided by the present invention. The article storage device 12 may be used to store a disctype article 14, such as a coin, a medal, a token or the like. The article storage device 12 includes a two-piece capsule having cylindrical cup members 20 and 22 of a rigid transparent material, such a butyrate. The cup members 20 and 22 have mating threads 21 and 23, respectively, which permit the cup members 20 and 22 to be screwed together, providing a substantially air-tight capsule for enclosing the article 14.

More specifically, cup member 20 has threads 21 formed on the outer surface 34 of an annular wall 30 which extends outwardly from a base portion 28 of cup member 20. The wall 30 defines a central recess 32 for receiving the article 14. The base portion 28 of cup member 20 extends beyond the wall 30 defining a flange 38.

The cup member 22, which serves as a cover for the storage device 12, has threads 23 formed on an inner surface 44 of an annular wall 42, which extends from a base portion 40 of cup member 22. The inner diameter of the threaded wall portion 23 of cup member 22 is substantially the same as the outer diameter of the threaded wall portion 21 of cup member 20 so that when the threaded cup members 20 and 22 are assembled together, the corresponding threaded surfaces 21 and 23 are in threaded engagement and the cover member 22 encloses the article 14 positioned within the recess 32, providing an enclosed storage compartment 33 for the article 14.

The threaded surfaces 21 and 23 provide positive interlocking of the two cup members 20 and 22. The threaded surfaces 21 and 23 also provide increased contact areas between the two cup members 20 and 22 and substantially eliminate air leakage into the storage compartment 33.

A thin washer 26, which may be of a material such as plastic or mylar, may be disposed between the peripheral edges of the two cup members 20 and 22, defined by the upper surface 37 of the flange portion 38 of the base member 28 and the lower surface 39 of the threaded wall 42 of cup member 22, to provide further sealing of the storage compartment 33 from the atmosphere.

Figure 2:
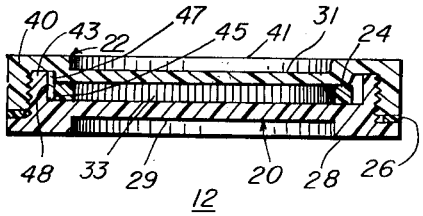
FIG. 2 is a side sectional view of the article storage device of FIG. 1, shown assembled.

As shown best in FIG. 2, which is a side sectional view of the storage device 12, shown assembled, the central portion 29 of the base 28 of cup member 20 and the central portion 31 of the base 40 of cup member 22 are recessed. An annular channel 47 formed on the inner surface of the base portion 40 receives the upper portion 43 of wall portion 30 of cup member 20 when the cup members 20 and 22 are assembled, minimizing the separation between the recessed center portions 29 and 31, thereby minimizing the area within the storage compartment.

When the storage device 12 is assembled as shown in FIG. 2, with an article 14 disposed within the storage chamber 33 thereof, the recessed portions 29 and 31 of the top and bottom surfaces of the cup members 20 and 22, respectively, provide transparent viewing windows, permitting the stored article 14 to be viewed from either side.

The storage device 12 may be provided in a number of basic sizes to store articles of different diameters, such as coins of different denominations. Adapter rings, such as adapter ring 24, shown in FIG. 1, may be provided to adapt an article holder 12 of a given size to an odd size article. The article is positioned within a central aperture 25 of the adapter ring 24 which has an inner diameter that is substantially the same as that of an article to be stored. The outer diameter of the adapter rings for a given size article holder 12 have the same outer diameter, and the height of the adapter ring 24 corresponds to the spacing between the center portions 29 and 31 of the cup members 20 and 22. The adapter ring 24 and the article 14, thus assembled together, are placed in the storage compartment 33. The annular wall 30 of cup member 20 has three projections 51, which extend inwardly from the wall 30 to provide a snug fit for the article and adapter ring assembly to prevent rotation of the adapter 24 and the article 14, and provide a gap 46 between the adapter ring 24 and the inner surface of wall 30 to facilitate removal of the enclosed object from the holder.

When the storage device 12 is assembled, the cup member 22 is threaded onto the cup member 20 and hand tightened. The upper surface 41 of cup member 22 has a pair of slots 53 for receiving a suitable tool, such as a screw driver or coin, for tightening the cover member 22 onto the base member 20. A flat surface, indicated generally at 55, may be provided on the peripheral edge of the cup member 22 to permit a label to be affixed to the capsule for recording the date, cost or the like of the article stored therein.

Figure 3:
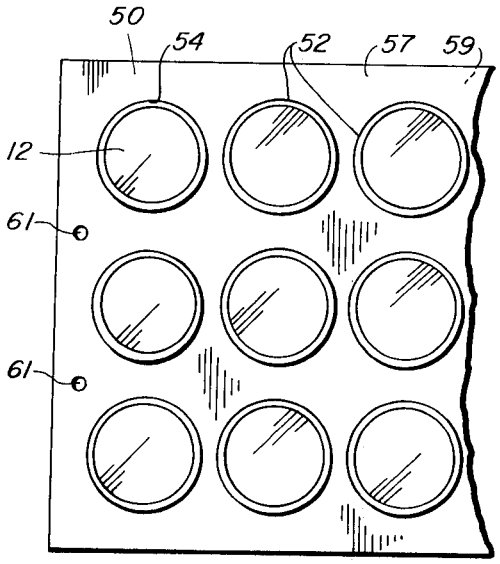
FIG. 3 is a plan view of a display assembly including a display board and a plurality of article storage devices of the type shown in FIG. 1.

The storage device 12 provides for storage of a single article 14, and also permits the encapsulated article to be mounted on a suitable mounting or display board, such as mounting board 50 shown in FIG. 3, along with a plurality of similar article storing storage devices to provide a unitary display assembly for a plurality of articles. The mounting board 50 may be of a rigid material such as plastic, metal, wood, a heavy cardboard, or a combination such as the type used in Whitman holders. Alternatively, the mounting board may be a transparent material, such as acrylic. The mounting board 50 is generally rectangular in shape and has a plurality of apertures 52 for receiving a like plurality of the storage devices 12. In one embodiment, the inner diameter of each aperture 52 corresponds to the outer diameter of the assembly 12 of a given size and different mounting boards, each having apertures of a given diameter are provided to accommodate the different sizes for the storage devices 12. Alternatively, a given mounting board may have apertures of different diameters for displaying articles of different sizes.

The outer edge of the storage device 12 may be milled and tapered to provide an interference fit between the outer edge of the storage device 12 and the inner surface 54 of the aperture 52 of the mounting board 50. The height of the storage device 12 corresponds to the thickness of the mounting board 50 to provide a flush fit relative to the upper and lower surfaces 57 and 59 of the mounting board 50. In accordance with a preferred embodiment of the invention, the article stored by each of the storage devices 12 may be added to or removed from the mounting board 50 while encapsulated by the storage device 12 such that the article is not subjected to tarnishing or other damage through handling or exposure to the atmosphere.

The mounting board 50 may have a plurality of mounting holes 61 disposed along a peripheral edge to permit a plurality of mounting boards to be assembled into a loose-leaf display book. Suitable front and back covers may be provided for such assembly, if desired.

Figure 4:
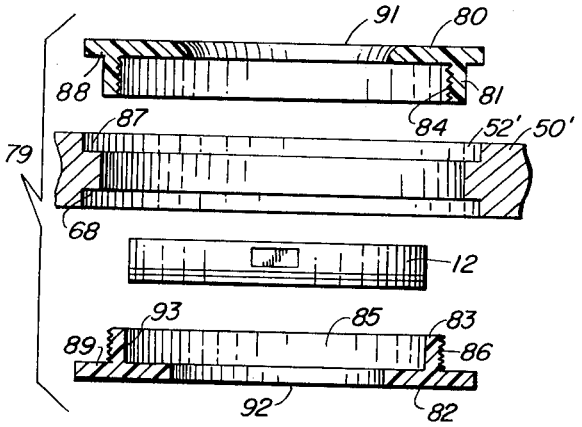
FIG. 4 shows the article storage device and a mounting assembly provided in accordance with one embodiment for a mounting assembly for mounting the article storage device on the display board.

Referring to FIG. 4, there is shown an alternative arrangement for mounting the storage device 12 on a modified mounting board 50' and which permits the storage device 12 to be quickly and easily mounted on or removed from the mounting board 50' while the article 14 remains encapsulated. Only that portion of the modified mounting board 50' which is adjacent one aperture 52' is shown in FIG. 4.

The mounting arrangement 79 includes a two-piece holder, including a cover member 80 and a base member 82 of a rigid material, which may be a suitable metal or butyrate, for example. The cover member 80 has an annular wall 81 having an inner threaded surface 84 and the base member 82 has an annular wall 83 having an outer threaded surface 86 which is received in threaded engagement with the threaded inner surface 84 of the cover member 80 when the mounting members 80 and 82 are assembled on the mounting board 50'. The wall 83 of base member 82 defines a central recess 85 in which the storage device 12 is received, with the storage device 12 resting on the upper surface 93 of base member 82. The inner diameter of the annular wall 83 of the base member 82 is approximately the same as the outer diameter of the storage device 12 to provide a snug fit and prevent rotational movement of the storage device 12 within the holder 79. The storage device 12 is substantially enclosed within the two-piece holder comprised of cover member 80 and base member 82, which mount the storage device 12 to the board 50'. The aperture 52' of board 50' is countersunk on both sides, defining shoulders 87 and 68 which are engaged by flanges 88 and 89 provided on the cover member 80 and the base member 82, respectively, to provide flush mounting of the mounting assembly 79 on the mounting board 50'. The cover member 80 and the base member 82 are open ended, having respective apertures 91 and 92 disposed centrally of the respective flanges 88 and 89 which expose the viewing surfaces of the storage device 12 and facilitate removal of the storage device 12 from the base member 82.

Figure 5:
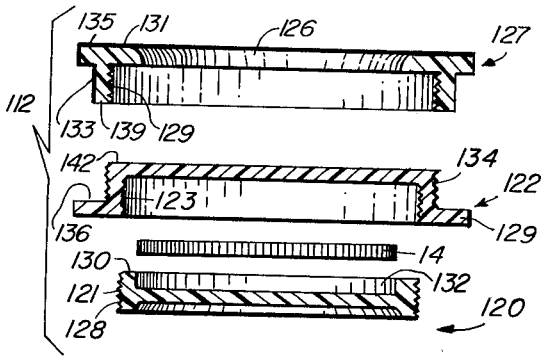
FIG. 5 shows a further embodiment for an article storage device provided by the present invention.
Figure 6:
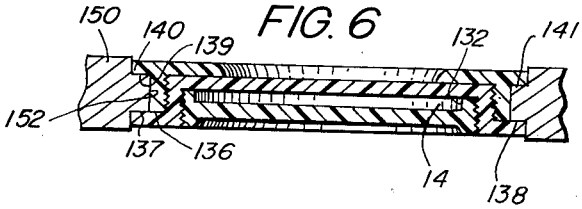
FIG. 6 illustrates the manner in which the article storage device of FIG. 5 is mounted on the display board.

Referring to FIG. 5, there is shown an exploded side view of a storage assembly 112 provided in accordance with a second embodiment of the invention. The storage device 112 is generally similar to storage device 12 shown in FIG. 1, and includes a pair of mating cup members 120 and 122 which enclose a disc-like article 14. The storage device 112 also includes an apertured mounting member 127 which permits the capsule formed by members 120 and 122 to be mounted on a modified mounting board 150, a portion of which is shown in FIG. 6, in a manner similar to that described above with reference to FIG. 4, but requires only one mounting member 127.

As shown in FIG. 5, cup member 120, which is of a transparent material, has an annular wall 130 extending generally perpendicularly to a base portion 128 at the periphery thereof, defining a central storage compartment 132 in which is received the article 14. The wall 130 has an external thread 121 which engages internal threads 123 formed on an inner surface of an annular wall 142 of cup member 122 when the cup members 120 and 122 are assembled as shown in FIG. 6. The annular wall 142 of member 122 terminates in a flange 129, and has threads 134 formed on its outer surface which cooperate with threads 129 formed on an annular wall 133 of mounting member 127. A base portion 131 of mounting member 127 terminates in a peripheral flange 135 and has a central aperture 126 provided adjacent to the viewing surface of cup member 122.

In this arrangement, the article 14 is first encapsulated by cup members 120 and 122, which provide a substantially airtight enclosure for the article 14. To mount the assembly 112 to the mounting board 150, the mounting member 127 is inserted into an aperture 152 of the board 150 from the upper surface of the board 150 and the capsule assembly is inserted into the aperture 152 from the lower surface of the board, and is screwed into the mounting member 127. When assembled, as shown in FIG. 6, the upper surface 136 of flange 129 of member 122 engages the lower surface 137 of the shoulder 138 formed by countersunk aperture 152 and the lower surface 139 of flange 135 of member 127 engages the upper surface 140 of the shoulder 141 formed by the countersunk aperture 152 in the mounting board 150. The cup members 120 and 122 may have countersunk viewing surfaces as described above with reference to the storage device 12 shown in FIG. 1, to minimize the size of the article storage compartment. In addition, the storage device 112 may also include a sealing washer (not shown), and may employ adapter rings as described above.

Figure 7:
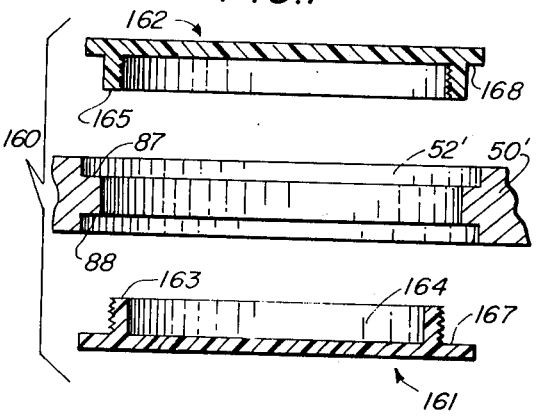
FIG. 7 shows another embodiment for an article storage device provided by the present invention, and illustrates the manner in which the article storage device is mounted on the display board; and, FIG. 8 shows a further embodiment for an article storage device provided by the present invention and illustrates the manner in which the article storage device is mounted on a modified display board.
Figure 8:
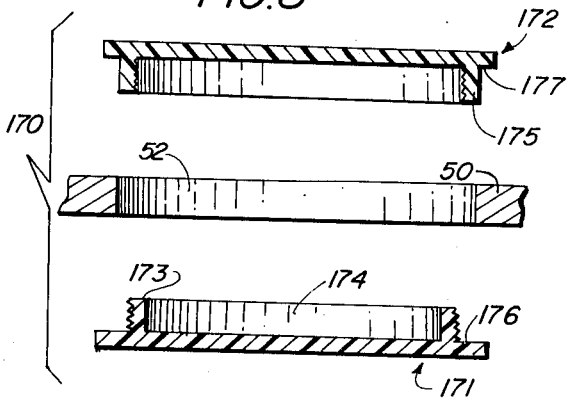

Referring to FIGS. 7 and 8, there are shown alternate embodiments of mounting arrangements for the storage device wherein the capsule is mounted directly to a mounting board. In the mounting arrangement 160 shown in FIG. 7, which employs mounting board 50' having countersunk apertures such as aperture 52' shown in FIG. 7, the storage device includes mating cup members 161 and 162. Cup member 161 is similar to cup member 20, shown in FIG. 1, except that the flange 167 extends further, beyond the externally threaded annular wall 163 and the peripheral edge of the flange engages a shoulder 88 of the countersunk aperture 52' in the board 50'. Cup member 162 is similar to cup member 22 of FIG. 1 except that a flange 168 is provided which engages a shoulder 87 of countersunk hole 52' of the board 50' when the storage device 12' is mounted on the board.

Referring to FIG. 8, the mounting arrangement 170 includes mating cup members 171 and 172. Cup member 171 is identical to cup member 20 (FIG. 1) and has a peripheral flange 176. The cup member 172 is similar to cup member 22 (FIG. 1) with the addition of a flange 177. In this embodiment, which employs mounting board 50, the flanges 176 and 177 engage the upper and lower surfaces of the mounting board 50.

I claim:

1. In a display assembly for at least one article, the combination comprising a mounting board having first and second opposing surfaces, and at least one aperture extending through both of said surfaces, and device storage means including first and second cup-shaped members which when assembled together form a storage device for enclosing said article, said first and second cup members each being generally cylindrical in shape and having a generally planar base portion and an annular wall portion extending perpendicularly to said base portion, said wall portion of said first cup member defining a central recess for receiving said article, said first cup member being mounted on said board with its base portion disposed adjacent to said first surface of said board and having its annular wall portion extending within said aperture, said second cup member being mounted on said board with its base portion disposed adjacent to said second surface of said board and having its annular wall portion extending within said aperture, the inner diameter of the annular wall portion of said second cup member being substantially the same as the outer diameter of the annular wall portion of said first cup member to permit said first and second cup members to be assembled together on said board with said annular wall portions in telescopic engagement to provide an enclosed compartment for said article, one of said cup members having engaging means formed on a surface thereof, and said other cup member having receptor means formed on a surface thereof which receives said engaging means when said cup members are assembled together to connect said first cup member to said second cup member, said base portions of said first and second cup members being of a transparant material providing opposing viewing surfaces to permit viewing of said article, said first and second cup members having respective first and second projecting portions formed integrally with peripheral edges of said base portions, and extending outwardly therefrom and generally coplanar with said base portions, said first and second projecting portions engaging said first and second opposing surfaces, respectively, of said board adjacent to said aperture when said first and second cup members are connected together to thereby secure said device storage means to said mounting board.

2. An assembly as set forth in claim 1 wherein said first and second cup members each have peripheral flange portions defining said projecting portions which engage said opposing surfaces of said mounting board.

3. In a display assembly for at least one article, the combination comprising a mounting board having a plurality of apertures, device storage means including a plurality of members, first and second ones of said members being cupshaped members which are coupled together forming a storage device for enclosing said article, said first and second cup members each being generally cylindrical in shape and having a base portion and an annular wall portion extending perpendicularly to said base portion, said wall portion of said first cup member defining a central recess for receiving said article and having threads formed on an outer surface thereof, and said wall portion of said second cup member having threads formed on an inner surface thereof, the inner diameter of the threaded wall portion of said second cup member being substantially the same as the diameter of the threaded wall portion of said first cup member to permit said second cup member to be assembled on said first cup member with said inner and outer surfaces of said wall portions in threaded engagement to provide an enclosed comparment for said article, said base portions of said first and second cup members being of a transparent material providing opposing viewing surfaces to permit viewing of said article, said device storage means having mounting means including a third member of said plurality and projecting portions formed integrally with peripheral edges of said second and third members and extending outwardly therefrom, said second cup member of said storage device having threads formed on the outer surface of its wall portion, and said third member being generally cylindrical in shape and having an annular wall portion with threads formed on an inner surface thereof, the inner diameter of the threaded wall portion of said third member being substantially the same as the outer diameter of the threaded outer wall portion of said second cup member to permit said third member and said assembled storage device to be mounted on said mounting board with said storage device extending through one of said apertures in said board with the corresponding threaded wall portions in threaded engagement, and with said projecting portions of said second and third members engaging opposing surfaces of said board adjacent to said one aperture to secure said device storage means to said mounting board to permit said storage device to be removed from said mounting board while assembled.

4. An assembly as set forth in claim 3 wherein each of the apertures in said board are countersunk on opposing surfaces defining first and second shoulders in each aperture, said third member having a flange portion extending beyond its threaded inner wall portion defining one of said projecting portions, and said second cup member having a flange portion extending beyond its threaded outer wall portion defining another one of said projecting portions, the flange portions of said third member and said second cup member engaging said first and second shoulders, respectively, of said one aperture permitting flush mounting of said third member and said storage device in said one aperture relative to said surfaces of said mounting board.

5. In a display assembly for at least one article, the combination comprising a mounting board having a plurality of apertures, device storage means including a a plurality of members, first and second ones of said members being cup-shaped members which are coupled together forming a storage device for enclosing said article, said first and second cup members each being generally cylindrical in shape and having a base portion and an annular wall portion extending perpendicularly to said base portion, said wall portion of said first cup member defining a central recess for receiving said article and having threads formed on an outer surface thereof, and said wall portion of said second cup member having threads formed on an inner surface thereof, the inner diameter of the threaded wall portion of said second cup member being substantially the same as the diameter of the threaded wall portion of said first cup member to permit said second cup member to be assembled on said first cup member with said inner and outer surfaces of said wall portions in threaded engagement to provide an enclosed compartment for said article, said base portions of said first and second cup members being of a transparent material providing opposing viewing surfaces to permit viewing of said article, said device storage means having mounting means including third and fourth members of said plurality which are assembled together to form a holder for mounting said storage device in one of said apertures of said board, said third member being generally cylindrical in shape and positionable within said one aperture and having a central recess for receiving said assembled storage device, and said fourth member being generally cylindrical in shape and adapted to be coupled to said third member, and means for securing said third member to said mounting board, including projecting portions formed integrally with peripheral edges of said third and fourth members and extending outwardly therefrom, said device storage means being mounted on said board with said storage device extending through one of said apertures of said board and with said projecting portions of said third and fourth members engaging opposing surfaces, of said board adjacent to said one aperture to secure said device storage means to said mounting board with said storage device substantially enclosed within said holder.

6. An assembly set forth in claim 5 wherein said third member has an externally threaded annular wall portion defining said recess and wherein said fourth member has an internally threaded wall portion which engages the threaded wall portion of said third member when said third member and said fourth member are assembled together on said mounting board.

7. An assembly set forth in claim 6 wherein each of the apertures in said mounting board is countersunk on opposing surfaces of said mounting board defining first and second shoulders in each aperture, said third member and said fourth member each having respective first and second flange portions extending beyond its threaded wall portion and defining said projecting portions which engage said first and second shoulders, respectively, to permit flush mounting of said holder in said one aperture relative to said surfaces of said mounting board.

8. In a display assembly for storing at least one article, and for permitting the article to be mounted on a mounting board having a plurality of apertures, the combination comprising a storage device for enclosing said article, said storage device having first and second cup members, each being generally cylindrical in shape and having a base portion and an annular wall portion extending perpendicularly to said base portion, said wall portion of said first cup member defining a central recess for receiving said article and having threads formed on an outer surface thereof, and said wall portion of said second cup member having threads formed on an inner surface thereof, the inner diameter of the threaded wall portion of said second cup member being substantially the same as the outer diameter of the threaded wall portion of said first cup member to permit said second cup member to be assembled on said first cup member with said inner and outer surfaces of said wall portions in threaded engagement to provide an enclosed compartment for said article, said base portions of said first and second cup members being of a transparent material providing opposing viewing surfaces to permit viewing of said article, said second cup member having threads formed on the outer surface of its wall portion, and a generally cylindrical mounting member having an annular wall portion with threads formed on an inner surface thereof, the inner diameter of the threaded wall portion of said mounting member being substantially the same as the outer diameter of the threaded outer wall portion of said second cup member to permit said mounting member and said assembled storage device to be mounted on said board in said one aperture with the corresponding threaded wall portions in threaded engagement, and to permit said storage device to be removed from said mounting board while assembled.

9. An assembly as set forth in claim 8 wherein said mounting member has a base portion having a central aperture which is disposed adjacent to the viewing surface of said second cup member when said mounting member is assembled with said storage device for exposing said viewing surface.

10. In a display and storage assembly for storing at least one article, and for permitting the article to be mounted on a mounting board, the combination comprising a storage device including first and second mating cup members assembled together to provide an enclosed compartment for encapsulating said article, and mounting means including a mounting member and retaining means for permitting said mounting member and said storage device to be assembled together with said mounting member connected to said storage device for securing said storage device to said mounting board, and for permitting said storage device to be removed from said mounting board while said cup members are assembled together providing said enclosed compartment, wherein said retaining means comprise receptor means formed on a surface of one of said first cup member and said mounting member, and engaging means formed on a surface of the other one of said first cup member and said mounting member for interlocking engagement with said receptor means to connect said mounting member to said first cup member when said mounting member and said storage device are assembled together on said mounting board.

11. In a display and storage assembly for storing at least one article, and for permitting the article to be mounted on a mounting board, the combination comprising a storage device including first and second mating cup members which when assembled together provide an enclosed compartment for encapsulating said article, and mounting means including a mounting member and retaining means including receptor means and engaging means for permitting said mounting member and said storage device to be assembled together for securing said storage device to said mounting board, and for permitting said storage device to be removed from said mounting board while said cup members are assembled together providing said enclosed compartment, one of said cup members of said storage device having an annular wall portion having said receptor means formed on an outer surface thereof, and said mounting member having an annular wall portion having said engaging means formed on an inner surface thereof for interlocking engagement with said receptor means when said storage device and said mounting member are assembled together on said mounting board.

* * * * *